US006702653B2

(12) United States Patent
Shibata

(10) Patent No.: US 6,702,653 B2
(45) Date of Patent: Mar. 9, 2004

(54) EYEGLASS LENS PROCESSING APPARATUS

(75) Inventor: Ryoji Shibata, Aichi (JP)

(73) Assignee: Nidek Co., Ltd., Aichi (JP)

( * ) Notice: Subject to any disclaimer, the term of this patent is extended or adjusted under 35 U.S.C. 154(b) by 32 days.

(21) Appl. No.: 09/880,910

(22) Filed: Jun. 15, 2001

(65) Prior Publication Data

US 2001/0053659 A1 Dec. 20, 2001

(30) Foreign Application Priority Data

Jun. 15, 2000 (JP) ..... P2000-184586

(51) Int. Cl.[7] ..... B24B 1/00
(52) U.S. Cl. ..... 451/42; 451/5; 451/255
(58) Field of Search ..... 451/42, 43, 44, 451/5, 240, 255, 256, 277, 323

(56) References Cited

U.S. PATENT DOCUMENTS

| | | | | |
|---|---|---|---|---|
| 5,138,770 A | | 8/1992 | Matsuyama | |
| 5,228,242 A | | 7/1993 | Matsuyama | |
| 5,333,412 A | | 8/1994 | Matsuyama | |
| 5,347,762 A | | 9/1994 | Shibata et al. | |
| 6,099,383 A | | 8/2000 | Mizuno et al. | |
| 6,220,926 B1 | | 4/2001 | Mizuno | |
| 6,250,989 B1 | * | 6/2001 | Mizuno | 451/5 |
| 6,261,150 B1 | * | 7/2001 | Mizuno et al. | 451/5 |
| 6,283,826 B1 | * | 9/2001 | Mizuno | 451/6 |
| 6,328,628 B1 | * | 12/2001 | Mizuno et al. | 451/5 |

FOREIGN PATENT DOCUMENTS

| | | |
|---|---|---|
| DE | 35 09 534 | 9/1986 |
| DE | 197 38 668 | 3/1999 |
| EP | 1 066 918 | 1/2001 |
| EP | 1 066 918 A2 | 1/2001 |
| JP | 55-157461 | 12/1980 |
| JP | 3-11526 | 1/1991 |
| JP | 3-20603 | 1/1991 |
| JP | 10-225853 | 8/1998 |
| JP | 10-277901 | 10/1998 |
| JP | 2907974 | 4/1999 |
| JP | 2918657 | 4/1999 |
| JP | 2925685 | 5/1999 |
| JP | 2001-18155 | 1/2001 |
| JP | 2001-150314 | 6/2001 |

* cited by examiner

*Primary Examiner*—Dung Van Nguyen
(74) *Attorney, Agent, or Firm*—Sughrue Mion, PLLC

(57) ABSTRACT

An eyeglass lens processing apparatus for processing a periphery of an eyeglass lens, comprises: a detecting unit, which detects an edge position of the lens based on inputted target lens shape data and layout data; a processing unit, which has at least one grinding tool and which processes the lens by relatively moving the lens with respect to the grinding tool, the at least one grinding tool being adapted to execute at least two types of processing including: a plane finish processing; a bevel finish processing; a plane polish processing; a bevel polish processing; a first groove processing; and a second groove processing; an input unit, which inputs data on ranges of the lens periphery and data on respective processing types to partially change the processing types to be executed on the lens periphery; a computing unit, which obtains processing data for the respective ranges, different in processing type, based on data on edge position and data on processing type corresponding respectively to the ranges; and a control unit, which generates a control signal to the processing unit based on the obtained processing data.

14 Claims, 15 Drawing Sheets

EYEGLASS LENS PROCESSING APPARATUS

BACKGROUND OF THE INVENTION

The present invention relates to the eyeglass lens processing apparatus for processing the periphery of an eyeglass lens.

There is known the eyeglass lens processing apparatus which performs bevel finishing processing, plane finishing processing, and groove processing over the periphery of an eyeglass lens based on target lens shape data (traced data of en eyeglass frame, a template, a pattern, a dummy lens or the like). Also, there is known the apparatus which has the function of further performing polishing (mirror processing) over the lens periphery after the finish processing.

However, in the conventional apparatus, the arrangement is such that a single processing is performed over the entire periphery of a lens, and hence the (kind of) processing cannot be partially changed. Thus, there is a problem that the degree of processing freedom with respect to the design of a frame etc. is limited.

In light of the aforesaid problem in the conventional technique, the invention has as its object to provide the eyeglass lens processing apparatus which can partially change the (king of) processing.

SUMMARY OF THE INVENTION

In order to solve the aforesaid technical problem, the invention is characterized by having the following arrangement.

(1) An eyeglass lens processing apparatus for processing a periphery of an eyeglass lens, comprising:

a detecting unit, which detects an edge position of the lens based on inputted target lens shape data and layout data;

a processing unit, which has at least one grinding tool and which processes the lens by relatively moving the lens with respect to the grinding tool, the at least one grinding tool being adapted to execute at least two types of processing including:

a plane finish processing in which the lens periphery is finished flatly;

a bevel finish processing in which a bevel is formed to the lens periphery;

a plane polish processing in which the lens periphery is finished into a flat polished surface;

a bevel polish processing in which the lens periphery is polished with a bevel formed thereto;

a first groove processing in which a first groove is formed to the lens periphery; and a second groove processing in which a second groove different in at least one of groove width and groove depth from the first groove is formed to the lens periphery;

an input unit, which inputs data on ranges of the lens periphery and data on respective processing types to partially change the processing types to be executed on the lens periphery;

a computing unit, which obtains processing data for the respective ranges, different in processing type, based on data on edge position and data on processing type corresponding respectively to the ranges; and a control unit, which generates a control signal to the processing unit based on the obtained processing data.

(2) The apparatus of (1), wherein:

the data on ranges of the lens periphery include range data designed at an eyeglass frame maker and stored in a storage medium together with the target lens shape data; and the input unit reads the range data together with the target lens shape data from the storage medium and inputs these data.

(3) The apparatus of (1), wherein:

the data on ranges of the lens periphery include range data designed at an eyeglass frame maker together with the target lens shape data; and the input unit inputs the range data and the target lens shape data via a communications net work.

(4) The apparatus of (1), wherein the input unit includes:

a display unit, which displays a target lens shape figure based on the inputted target lens shape data; and a specifying unit, which specifies the ranges on the displayed target lens shape figure.

(5) The apparatus of (1), wherein the input unit includes a selection unit, which selects, from stored processing types, a desired processing type for each of the ranges.

(6) The apparatus of (1), wherein the input unit inputs data on groove width and groove depth of the first groove and data on groove width and groove depth of the second groove when the first groove processing and the second groove processing are inputted as the processing types.

(7) The apparatus of (1), further comprising:

a measuring unit, which measures an eyeglass frame, a template or a dummy lens, and inputs measured configuration data as the target lens shape data.

(8) The apparatus of (1), further comprising:

a layout input unit, which inputs the layout data for layout of the lens with respect to the inputted target lens shape data.

(9) An eyeglass lens processing apparatus for processing a periphery of an eyeglass lens, comprising:

a detecting unit, which detects an edge position of the lens based on inputted target lens shape data and layout data;

a processing unit, which has at least one grinding tool and which processes the lens by relatively moving the lens with respect to the grinding tool, the at least one grinding tool being adapted to execute at least two types of processing including:

a plane finish processing in which the lens periphery is finished flatly;

a bevel finish processing in which a bevel is formed to the lens periphery;

a plane polish processing in which the lens periphery is finished into a flat polished surface;

a bevel polish processing in which the lens periphery is polished with a bevel formed thereto;

a first groove processing in which a first groove is formed to the lens periphery; and a second groove processing in which a second groove different in at least one of groove width and groove depth from the first groove is formed to the lens periphery;

an input unit, which inputs data on ranges of the lens periphery and data on respective processing types to partially change the processing types to be executed on the lens periphery;

a display unit, which displays, based on the inputted target lens shape data, a target lens shape figure, with which the inputted ranges can be confirmed;

a computing unit, which obtains processing data for the respective ranges, different in processing type, based on data on edge position and data on processing type corresponding respectively to the ranges; and a control unit, which generates a control signal to the processing unit based on the obtained processing data.

(10) The apparatus of (9), wherein the input unit includes a specifying unit, which specifies the ranges on the displayed target lens shape figure.

(11) The apparatus of (9), wherein the input unit includes a selection unit, which selects, from stored processing types, a desired processing type for each of the ranges.

(12) The apparatus of (9), wherein the display unit displays a sectional shape of a specified edge position.

The present disclosure relates to the subject matter contained in Japanese patent application No. 2000-184586 (filed on Jun. 15, 2000), which is expressly incorporated herein by reference in its entirety.

DESCRIPTION OF THE PREFERRED EMBODIMENT

Hereafter, a description will be given of an embodiment of the invention.

(1) Overall Construction

Figure 1:
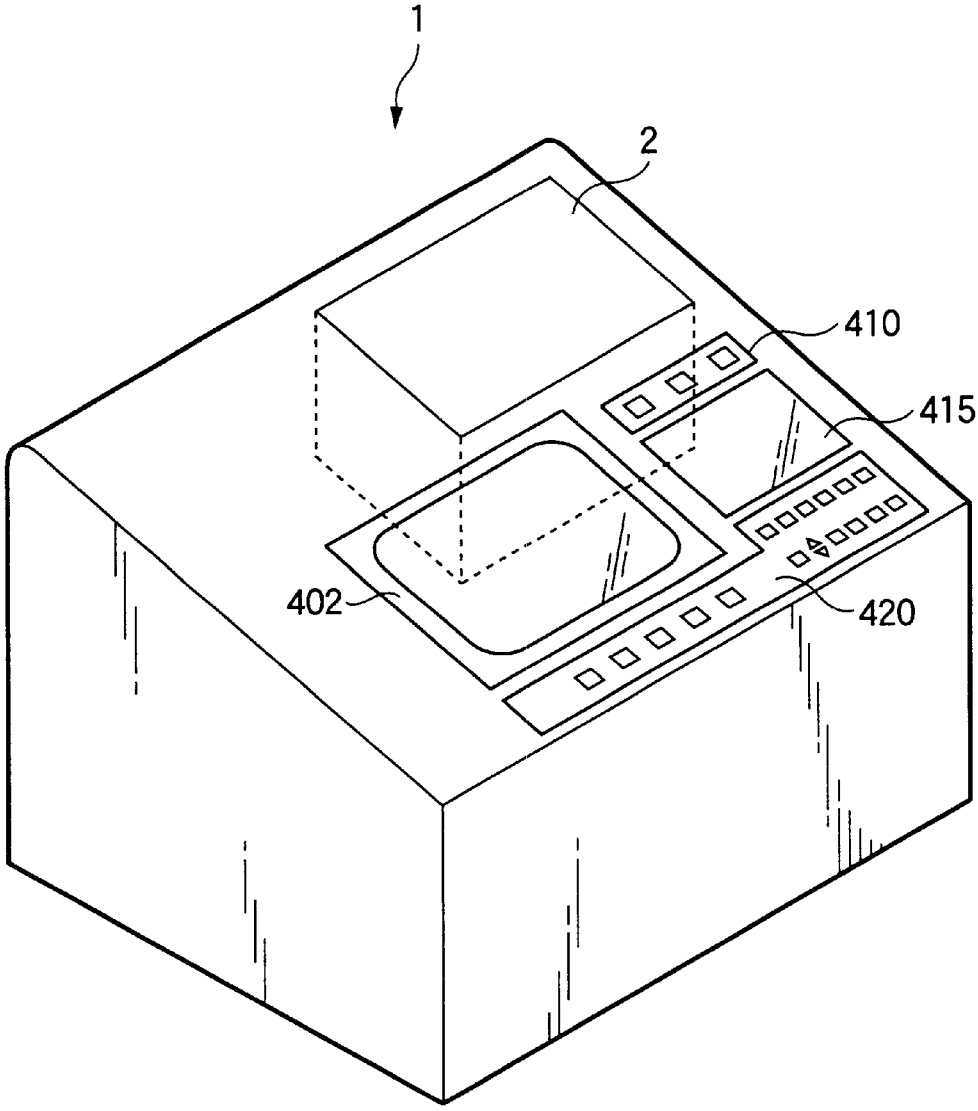
FIG. 1 is a view of the external configuration of an eyeglass lens processing apparatus according to the invention.

FIG. 1 is a diagram illustrating the external configuration of an eyeglass-lens processing apparatus in accordance with the invention. An eyeglass-frame-shape measuring device 2 is incorporated in an upper right-hand rear portion of a main body 1 of the apparatus. As the frame-shape measuring device 2, ones that disclosed in U.S. Pat. Nos. 5,228,242, 5,333,412, 5,347,762 (Re. 35,898) and so on, the assignee of which is the same as the present application, can be used. A switch panel section 410 having switches for operating the frame-shape measuring device 2 and a display 415 for displaying processing information and the like are disposed in front of the frame-shape measuring device 2. Further, reference numeral 420 denotes a switch panel section having various switches for inputting processing conditions and the like and for giving instructions for processing, and numeral 402 denotes an openable window for a processing chamber.

Figure 2:
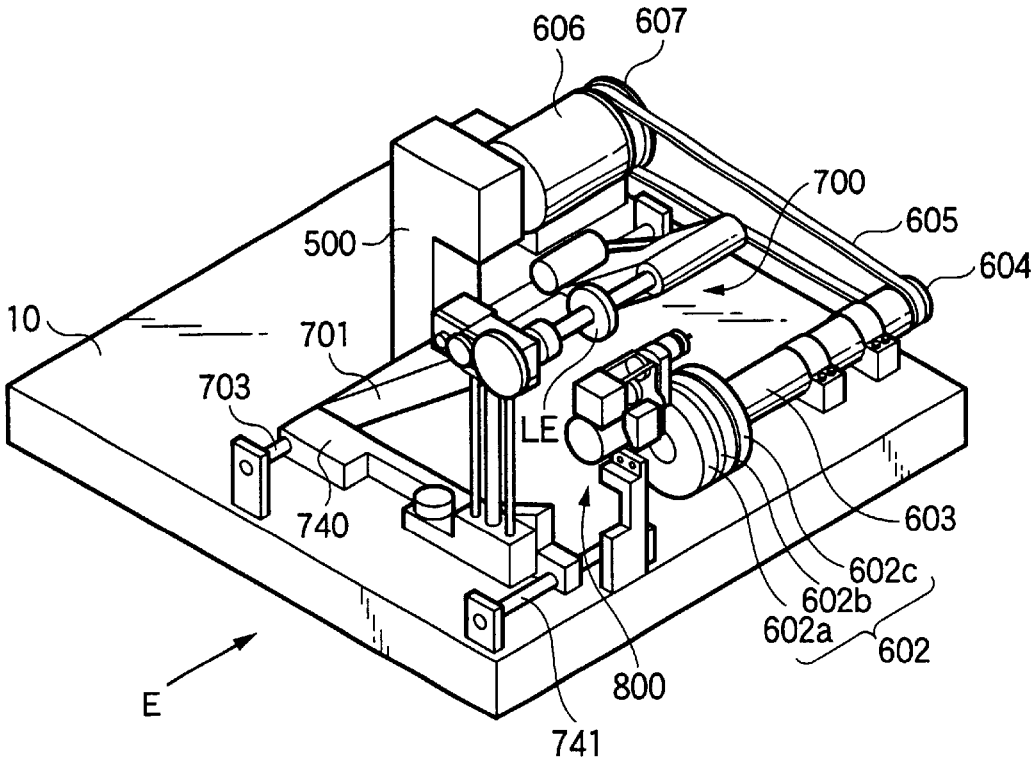
FIG. 2 is a perspective view showing the arrangement of a lens processing section disposed within a casing of the apparatus body.

FIG. 2 is a perspective view illustrating the arrangement of a lens processing section disposed in the casing of the main body 1. A carriage section 700 is mounted on a base 10, and a subject lens LE clamped by a pair of lens chuck shafts of a carriage 701 is ground by a group of abrasive wheels 602 attached to a rotating shaft 601. The group of abrasive wheels 602 include a rough abrasive wheel 602*a* for plastic lenses, a finish abrasive wheel 602*b* having processing surfaces for beveling processing and flat processing, and a polish abrasive wheel 602*c* having processing surfaces for beveling processing and flat processing. The rotating shaft 601 is rotatably attached to the base 10 by a spindle 603. A pulley 604 is attached to an end of the rotating shaft 601, and is linked through a belt 605 to a pulley 607 which is attached to a rotating shaft of an abrasive-wheel rotating motor 606.

A lens-shape measuring section 500 is provided in the rear of the carriage 701. Further, a chamfering and grooving mechanism section 800 is provided in the front side.

(2) Construction of Various Sections (A) Carriage Section

Figure 3A:
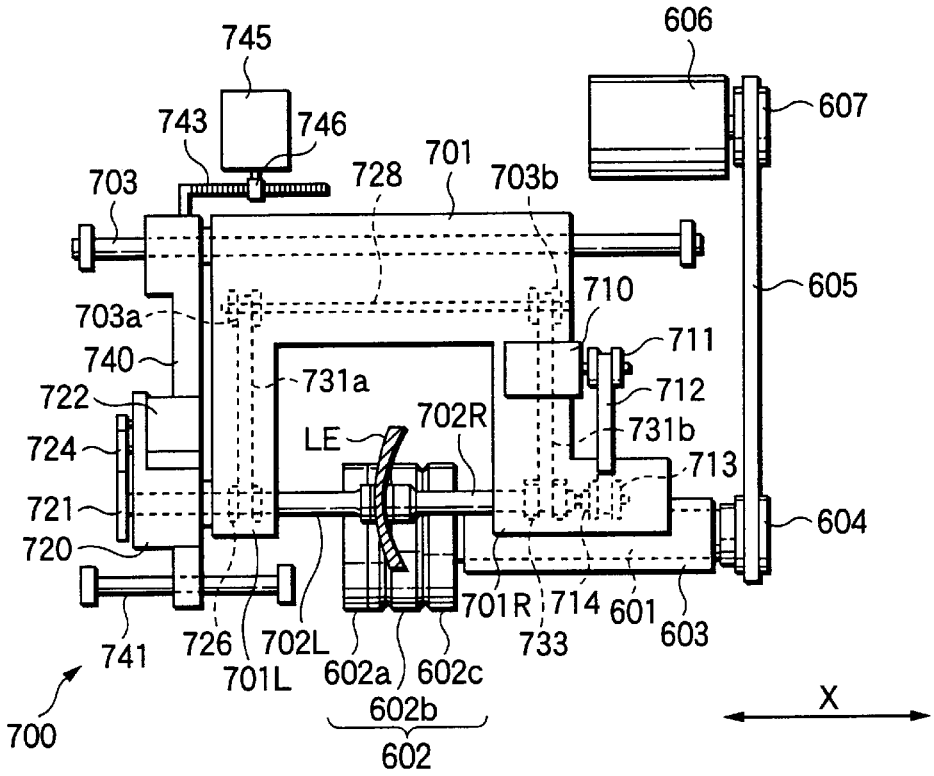
FIGS. 3*a* and 3*b* are views schematically showing the main portions of a carriage section.
Figure 3B:
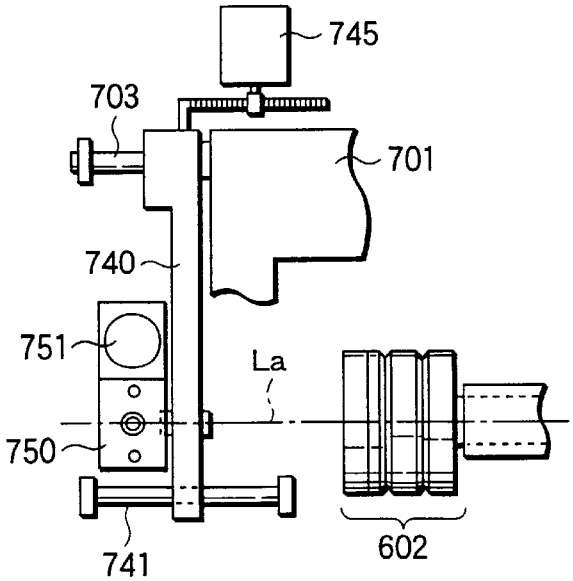
Figure 4:
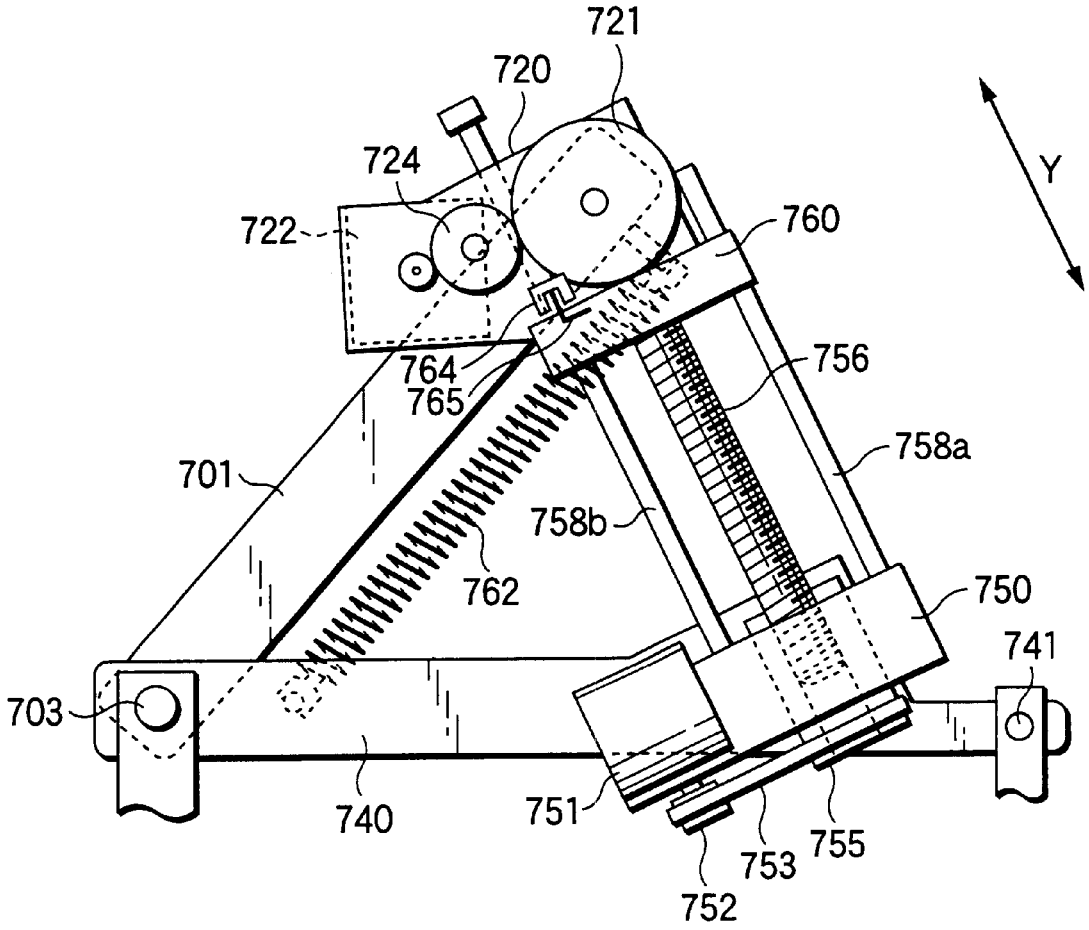
FIG. 4 is a view, taken from the direction of arrow E in FIG. 2, of the carriage section.

Referring to FIGS. 2, 3, and 4, a description will be given of the construction of the carriage section 700. FIG. 3 is a schematic diagram of essential portions of the carriage section 700, and FIG. 4 is a view, taken from the direction of arrow E in FIG. 2, of the carriage section 700.

The carriage 701 is capable of rotating the lens LE while chucking it with two lens chuck shafts (lens rotating shafts) 702L and 702R, and is rotatably slidable with respect to a carriage shaft 703 that is fixed to the base 10 and that extends in parallel to the abrasive-wheel rotating shaft 601. Hereafter, a description will be given of a lens chuck mechanism and a lens rotating mechanism as well as an X-axis moving mechanism and a Y-axis moving mechanism of the carriage 701 by assuming that the direction in which the carriage 701 is moved in parallel to the abrasive-wheel rotating shaft 601 is the X axis, and the direction for changing the axis-to-axis distance between the chuck shafts (702L, 702R) and the abrasive-wheel rotating shaft 601 by the rotation of the carriage 701 is the Y axis.

<Lens Chuck Mechanism and Lens Rotating Mechanism>

The chuck shaft 702L and the chuck shaft 702R are rotatably held coaxially by a left arm 701L and a right arm 701R, respectively, of the carriage 701. A chucking motor 710 is fixed to the center of the upper surface of the right arm 701R, and the rotation of a pulley 711 attached to a rotating shaft of the motor 710 rotates a feed screw 713, which is rotatably held inside the right arm 701R, by means of a belt 712. A feed nut 714 is moved in the axial direction by the rotation of the feed screw 713. As a result, the chuck shaft 702R connected to the feed nut 714 can be moved in the axial direction, so that the lens LE is clamped by the chuck shafts 702L and 702R.

A rotatable block 720 for attaching a motor, which is rotatable about the axis of the chuck shaft 702L, is attached to a left-side end portion of the left arm 701L, and the chuck shaft 702L is passed through the block 720, a gear 721 being secured to the left end of the chuck shaft 702L. A pulse motor 722 for lens rotation is fixed to the block 720, and as the motor 722 rotates the gear 721 through a gear 724, the rotation of the motor 720 is transmitted to the chuck shaft 702L. A pulley 726 is attached to the chuck shaft 702L inside the left arm 701L. The pulley 726 is linked by means of a timing belt 731*a* to a pulley 703*a* secured to a left end of a rotating shaft 728, which is held rotatably in the rear of the carriage 701. Further, a pulley 703*b* secured to a right end of the rotating shaft 728 is linked by means of a timing belt 731*b* to a pulley 733 which is attached to the chuck shaft 702R in such a manner as to be slidable in the axial direction of the chuck shaft 702R inside the right arm 701R. By virtue of this arrangement, the chuck shaft 702L and the chuck shaft 702R are rotated synchronously.

<X-Axis Moving Mechanism and Y-Axis Moving Mechanism of Carriage>

The carriage shaft 703 is provided with a movable arm 740 which is slidable in its axial direction so that the arm 740 is movable in the X-axis direction (in the axial direction of the shaft 703) together with the carriage 701. Further, the arm 740 at its front portion is slidable on and along a guide shaft 741 that is secured to the base 10 in a parallel positional relation to the shaft 703. A rack 743 extending in parallel to the shaft 703 is attached to a rear portion of the arm 740, and this rack 743 meshes with a pinion 746 attached to a rotating shaft of a motor 745 for moving the carriage in the X-axis direction, the motor 745 being secured to the base 10. By virtue of the above-described arrangement, the motor 745 is able to move the carriage 701 together with the arm 740 in the axial direction of the shaft 703 (in the X-axis direction).

As shown in FIG. 3(*b*), a swingable block 750 is attached to the arm 740 in such a manner as to be rotatable about the axis La which is in alignment with the rotational center of the abrasive wheels 602. The distance from the center of the shaft 703 to the axis La and the distance from the center of the shaft 703 to the rotational center of the chuck shaft (702L, 702R) are set to be identical. A Y-axis moving motor 751 is attached to the swingable block 750, and the rotation of the motor 751 is transmitted by means of a pulley 752 and a belt 753 to a female screw 755 held rotatably in the swingable block 750. A feed screw 756 is inserted in a threaded portion of the female screw 755 in mesh therewith, and the feed screw 756 is moved vertically by the rotation of the female screw 755.

A guide block 760 which abuts against a lower end surface of the motor-attaching block 720 is fixed to an upper end of the feed screw 756, and the guide block 760 moves along two guide shafts 758*a* and 758*b* implanted on the swingable block 750. Accordingly, as the guide block 760 is vertically moved together with the feed screw 756 by the rotation of the motor 751, it is possible to change the vertical position of the block 720 abutting against the guide block 760. As a result, the vertical position of the carriage 701 attached to the block 720 can be also changed (namely, the carriage 701 rotates about the shaft 703 to change the axis-to-axis distance between the chuck shafts (702L, 702R) and the abrasive-wheel rotating shaft 601). A spring 762 is stretched between the left arm 701L and the arm 740, so that the carriage 701 is constantly urged downward to impart processing pressure onto the lens LE. Although the downward urging force acts on the carriage 701, the downward movement of the carriage 701 is restricted such that the carriage 701 can only be lowered down to the position in which the block 720 abuts against the guide block 760. A sensor 764 for detecting an end of processing is attached to the block 720, and the sensor 764 detects the end of processing (ground state) by detecting the position of a sensor plate 765 attached to the guide block 760.

(B) Lens-Shape Measuring Section

Figure 5:
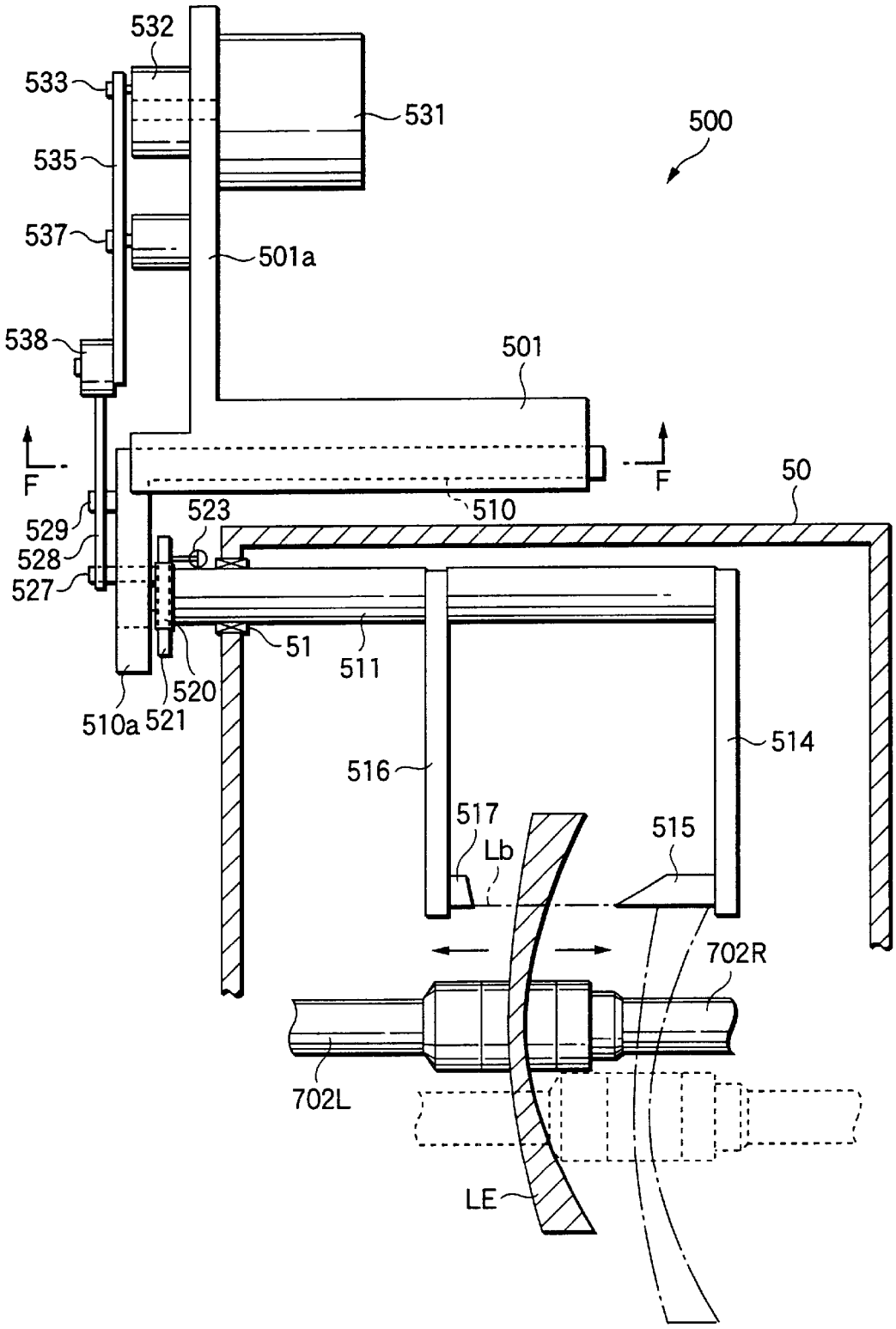
FIG. 5 is a top view of a lens shape measuring section.
Figure 6:
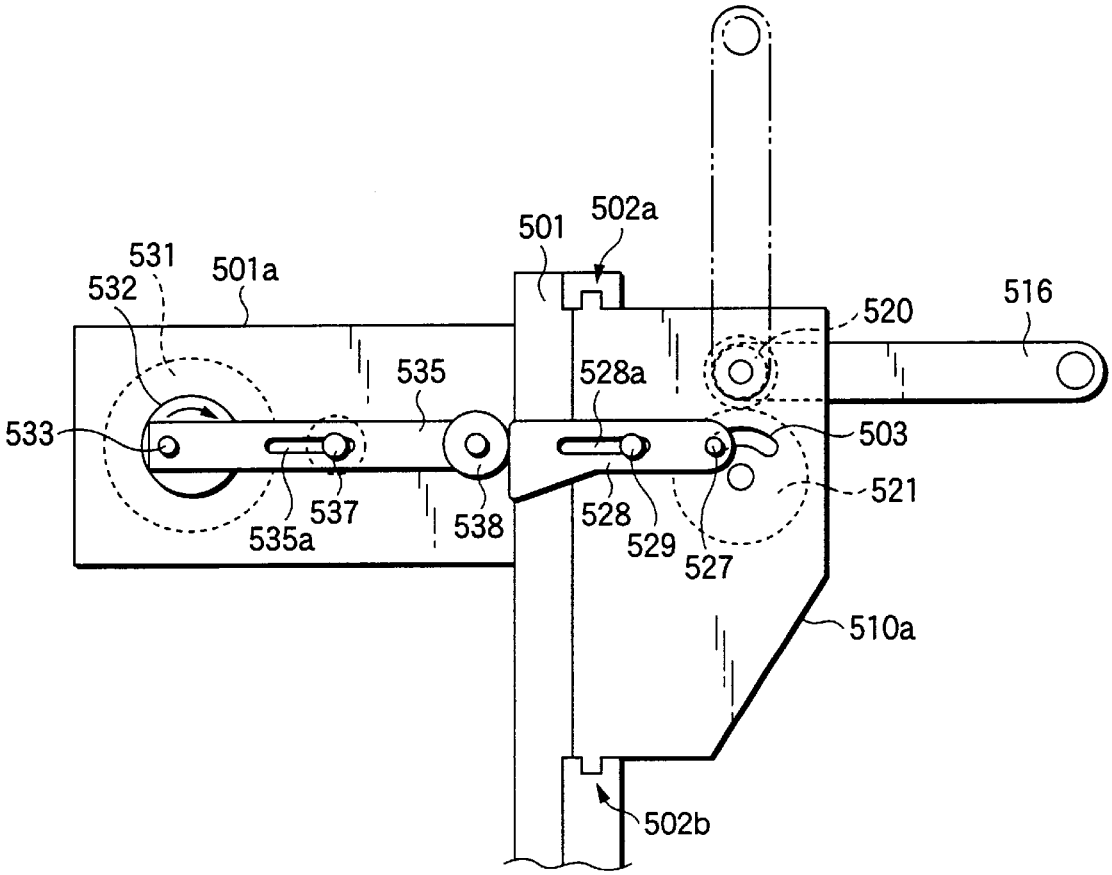
FIG. 6 is a left elevation of FIG. 5.
Figure 7:
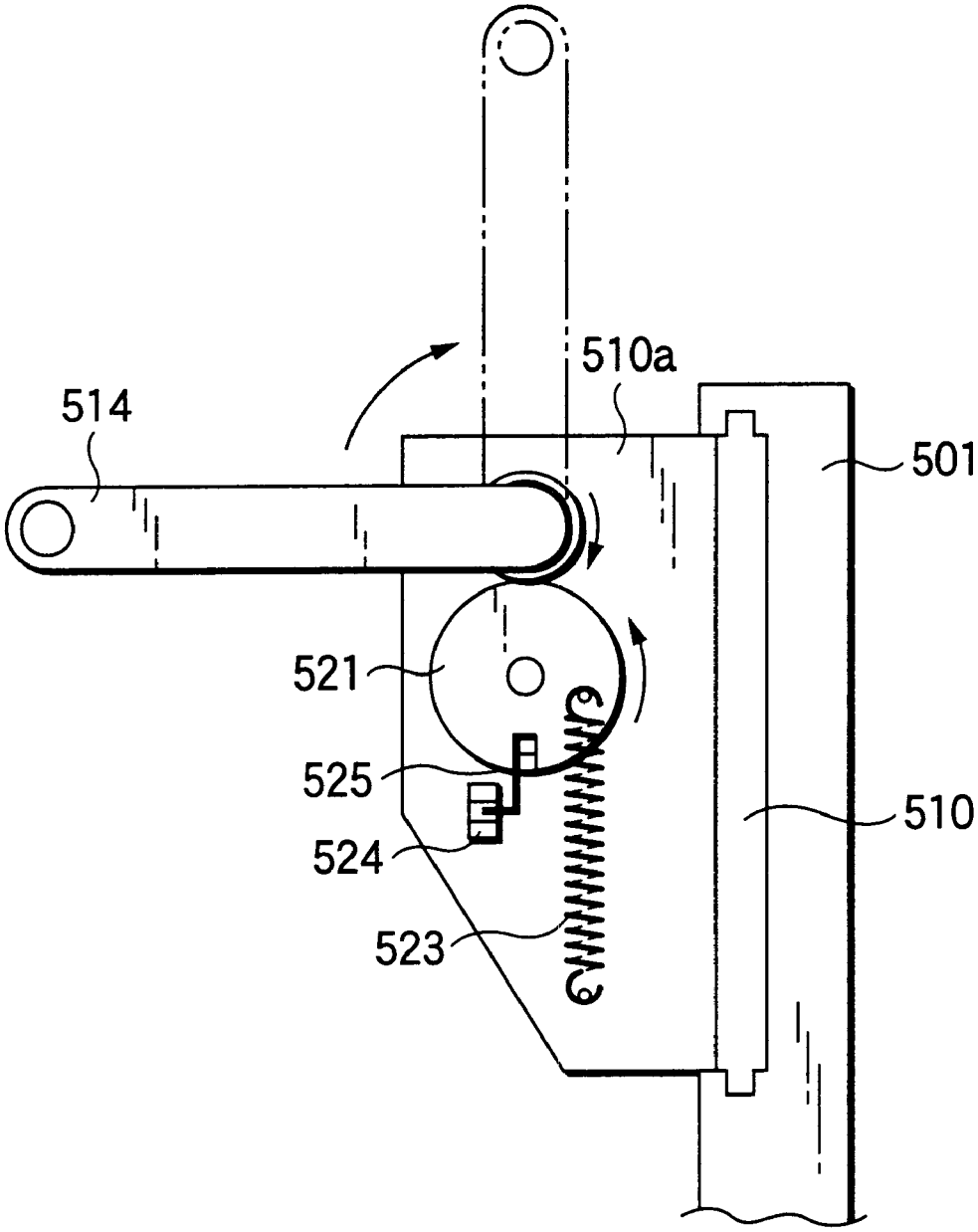
FIG. 7 is a view showing the main portion of the right lateral of FIG. 5.
Figure 8:
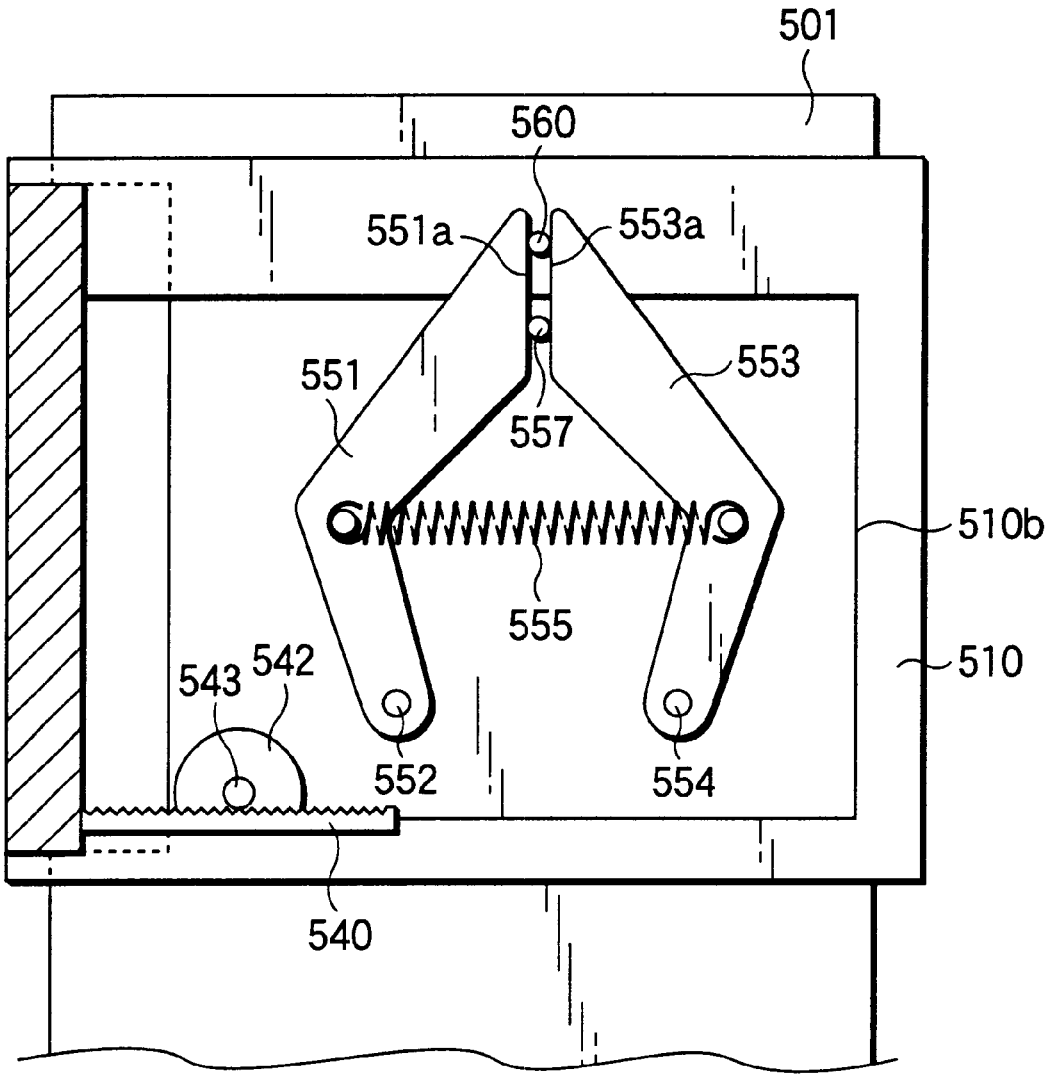
FIG. 8 is a sectional view taken along line F—F in FIG. 5.

Referring to FIGS. 5 to 8, a description will be given of the construction of the lens-shape measuring section 500. FIG. 5 is a top view of the lens-shape measuring section, FIG. 6 is a left side elevational view of FIG. 5, and FIG. 7 is a view illustrating essential portions of the right side surface shown in FIG. 5. FIG. 8 is a cross-sectional view taken along line F—F in FIG. 5.

A supporting block 501 is provided uprightly on the base 10. A sliding base 510 is held on the supporting block 501 in such a manner as to be slidable in the left-and-right direction (in a direction parallel to the chuck shafts) by means of a pair of upper and lower guide rail portions 502*a* and 502*b* juxtaposed vertically. A forwardly extending side plate 510*a* is formed integrally at a left end of the sliding base 510, and a shaft 511 having a parallel positional relation to the chuck shafts 702L and 702R is rotatably attached to the side plate 510*a*. A feeler arm 514 having a feeler 515 for measuring the lens rear surface is secured to a right end portion of the shaft 511, while a feeler arm 516 having a feeler 517 for measuring the lens front surface is secured to the shaft 511 at a position close to its center. Both the feeler 515 and the feeler 517 have a hollow cylindrical shape, a distal end portion of each of the feelers is obliquely cut as shown in FIG. 5, and the obliquely cut tip comes into contact with the rear surface or front surface of the lens LE. Contact points of the feeler 515 and the feeler 517 are opposed to each other, and the interval therebetween is arranged to be constant. Incidentally, the axis Lb connecting the contact point of the feeler 515 and the contact point of the feeler 517 is in a predetermined parallel positional relation to the axis of the chuck shafts (702L, 702R) in the state of measurement shown in FIG. 5. Further, the feeler 515 has a slightly longer hollow cylindrical portion, and measurement is effected by causing its side surface to abut against an edge surface of the lens LE during the measurement of the outside diameter of the lens LE.

A small gear 520 is fixed to a proximal portion of the shaft 511, and a large gear 521 which is rotatably provided on the side plate 510*a* is in mesh with the small gear 520. A spring 523 is stretched between the large gear 521 and a lower portion of the side plate 510*a*, so that the large gear 521 is constantly pulled in the direction of rotating clockwise in FIG. 7 by the spring 523. Namely, the arms 514 and 516 are urged so as to rotate downward by means of the small gear 520.

A slot 503 is formed in the side plate 510*a*, and a pin 527 which is eccentrically secured to the large gear 521 is passed through the slot 503. A first moving plate 528 for rotating the large gear 521 is attached to the pin 527. An elongated hole 528*a* is formed substantially in the center of the first moving plate 528, and a fixed pin 529 secured to the side plate 510*a* is engaged in the elongated hole 528*a*.

Further, a motor 531 for arm rotation is attached to a rear plate 501*a* extending in the rear of the supporting block 501, and an eccentric pin 533 at a position eccentric from a rotating shaft of the motor 531 is attached to a rotating member 532 provided on a rotating shaft of the motor 531. A second moving plate 535 for moving the first moving plate 528 in the back-and-forth direction (in the left-and-right direction in FIG. 6) is attached to the eccentric pin 533. An elongated hole 535*a* is formed substantially in the center of the second moving plate 535, and a fixed pin 537 which is fixed to the rear plate 501*a* is engaged in the elongated hole 535*a*. A roller 538 is rotatably attached to an end portion of the second moving plate 535.

When the eccentric pin 533 is rotated clockwise from the state shown in FIG. 6 by the rotation of the motor 531, the second moving plate 535 moves forward (rightward in FIG. 6) by being guided by the fixed pin 537 and the elongated hole 535*a*. Since the roller 538 abuts against the end face of the first moving plate 528, the roller 538 moves the first moving plate 528 in the forward direction as well owing to the movement of the second moving plate 535. As a result of this movement, the first moving plate 528 rotates the large gear 521 by means of the pin 527. The rotation of the large gear 521, in turn, causes the feeler arms 514 and 516 attached to the shaft 511 to retreat to an upright state. The driving by the motor 531 to this retreated position is determined as an unillustrated micro switch detects the rotated position of the rotating member 532.

If the motor 531 is reversely rotated, the second moving plate 535 is pulled back, the large gear 521 is rotated by being pulled by the spring 523, and the feeler arms 514 and 516 are inclined toward the front side. The rotation of the large gear 521 is limited as the pin 527 comes into contact with an end surface of the slot 503 formed in the side plate 510*a*, thereby determining the measurement positions of the feeler arms 514 and 516. The rotation of the feeler arms 514 and 516 up to this measurement positions is detected as the position of a sensor plate 525 attached to the large gear 521 is detected by a sensor 524 attached to the side plate 510*a*, as shown in FIG. 7.

Figure 9A:
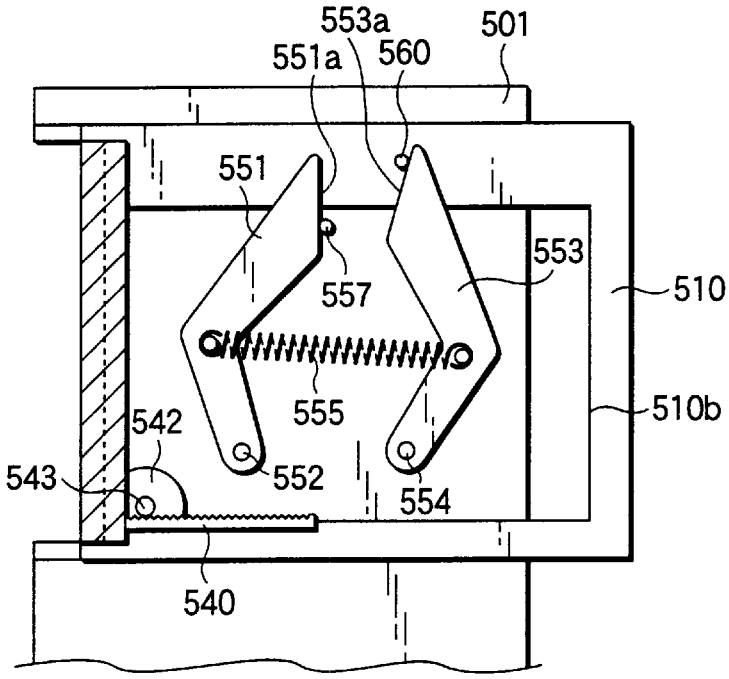
FIGS. 9*a* and 9*b* are views illustrating the state of right-and-left movement of the lens shape measuring section.
Figure 9B:
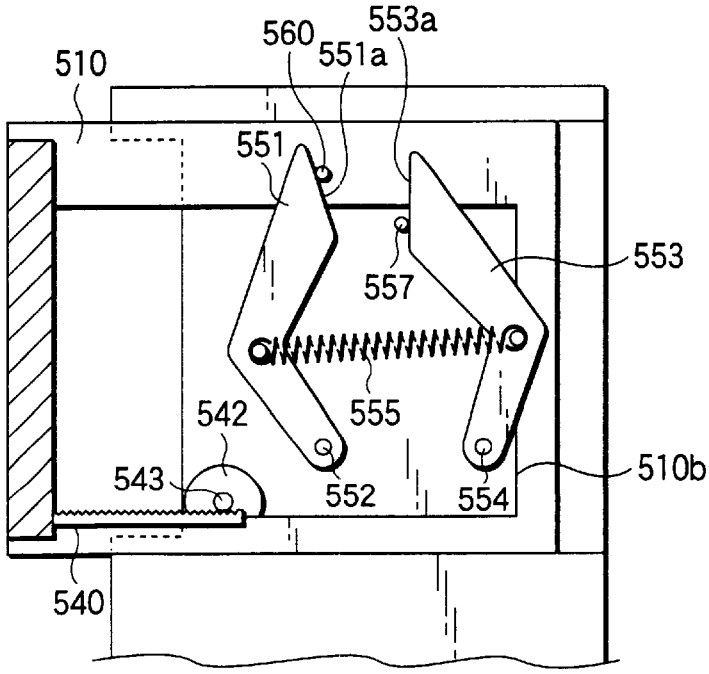

Referring to FIGS. 8 and 9, a description will be given of a left-and-right moving mechanism of the sliding base 510 (feeler arms 514, 515). FIG. 9 is a diagram illustrating the state of left-and-right movement.

An opening 510*b* is formed in the sliding base 510, and a rack 540 is provided at a lower end of the opening Slob. The rack 540 meshes with a pinion 543 of an encoder 542 fixed to the supporting block 501, and the encoder 542 detects the direction of the left-and-right movement and the amount of movement of the sliding base 510. A chevron-shaped driving plate 551 and an inverse chevron-shaped driving plate 553 are attached to a wall surface of the supporting block 501, which is exposed through the opening 510*b* in the sliding base 510, in such a manner as to be rotatable about a shaft 552 and a shaft 554, respectively. A spring 555 having urging forces in the directions in which the driving plate 551 and the driving plate 553 approach each other is stretched between the two driving plates 551 and 553. Further, a limiting pin 557 is embedded in the wall surface of the supporting block 501, and when an external force is not acting upon the sliding base 510, both an upper end face 551*a* of the driving plate 551 and an upper end face 553*a* of the driving plate 553 are in a state of abutting against the limiting pin 557, and this limiting pin 557 serves as an origin of the left- and rightward movement.

Meanwhile, a guide pin 560 is secured to an upper portion of the sliding base 510 at a position between the upper end face 551*a* of the driving plate 551 and the upper end face 553*a* of the driving plate 553. When a rightwardly moving force acts upon the sliding base 510, as shown in FIG. 9(*a*), the guide pin 560 abuts against the upper end face 553*a* of the driving plate 553, causing the driving plate 553 to be tilted rightward. At this time, since the driving plate 551 is fixed by the limiting pin 557, the sliding base 510 is urged in the direction of being returned to the origin of left- and rightward movement (in the leftward direction) by the spring 555. On the other hand, when a leftwardly moving force acts upon the sliding base 510, as shown in FIG. 9(*b*), the guide pin 560 abuts against the upper end face 551*a* of the driving plate 551, and the driving plate 551 is tilted leftward, but the driving plate 553 is fixed by the limiting pin 557. Accordingly, the sliding base 510 this time is urged in the direction of being returned to the origin of left- and rightward movement (in the rightward direction) by the spring 555. From such movement of the sliding base 510, the amount of movement of the feeler 515 in contact with the lens rear surface and the feeler 517 in contact with the lens front surface (the amount of axial movement of the chuck shafts) is detected by a single encoder 542.

It should be noted that, in FIG. 5, reference numeral 50 denotes a waterproof cover, and only the shaft 511, the feeler arms 514 and 516, and the feelers 515 and 517 are exposed in the waterproof cover 50. Numeral 51 denotes a sealant for sealing the gap between the waterproof cover 50 and the shaft 511. Although a coolant is jetted out from an unillustrated nozzle during processing, since the lens-shape measuring section 500 is disposed in the rear of the processing chamber and by virtue of the above-described arrangement, it is possible to provide waterproofing for the electrical components and moving mechanism of the lens-shape measuring section 500 by merely providing shielding for the shaft 511 exposed in the waterproof cover 50, and the waterproofing structure is thus simplified.

(C) Chamfering and Grooving Mechanism Section

Figure 10:
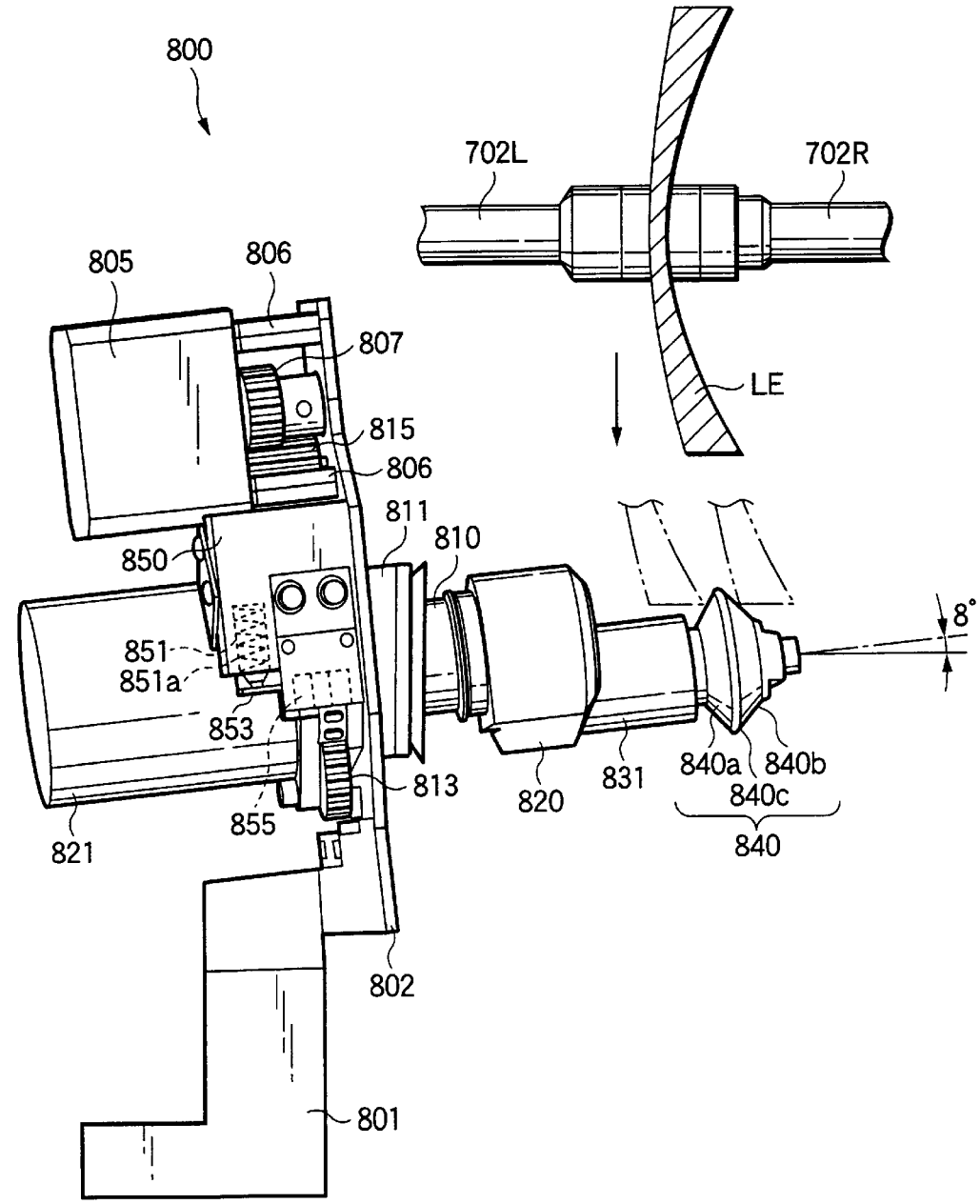
FIG. 10 is a front view of a chamfering and grooving mechanism section.
Figure 11:
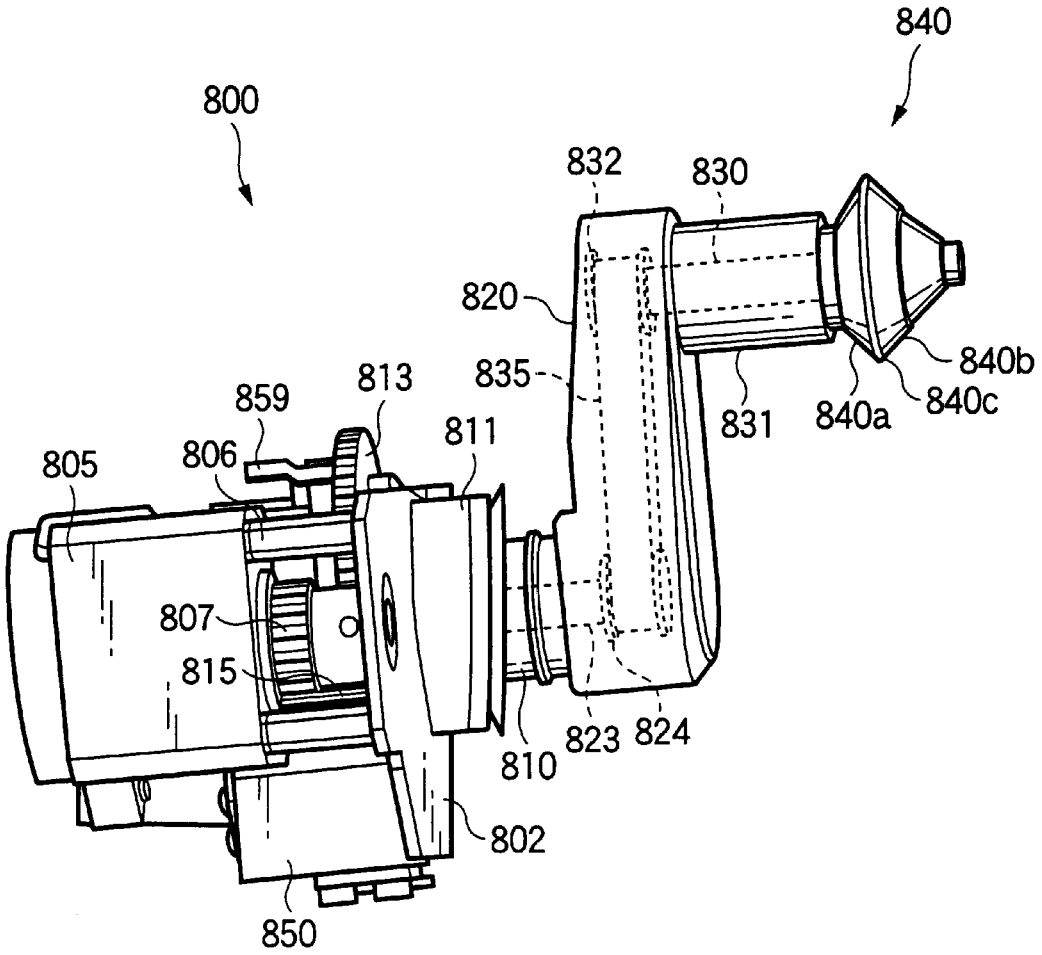
FIG. 11 is atop view of the chamfering and grooving mechanism section.
Figure 12:
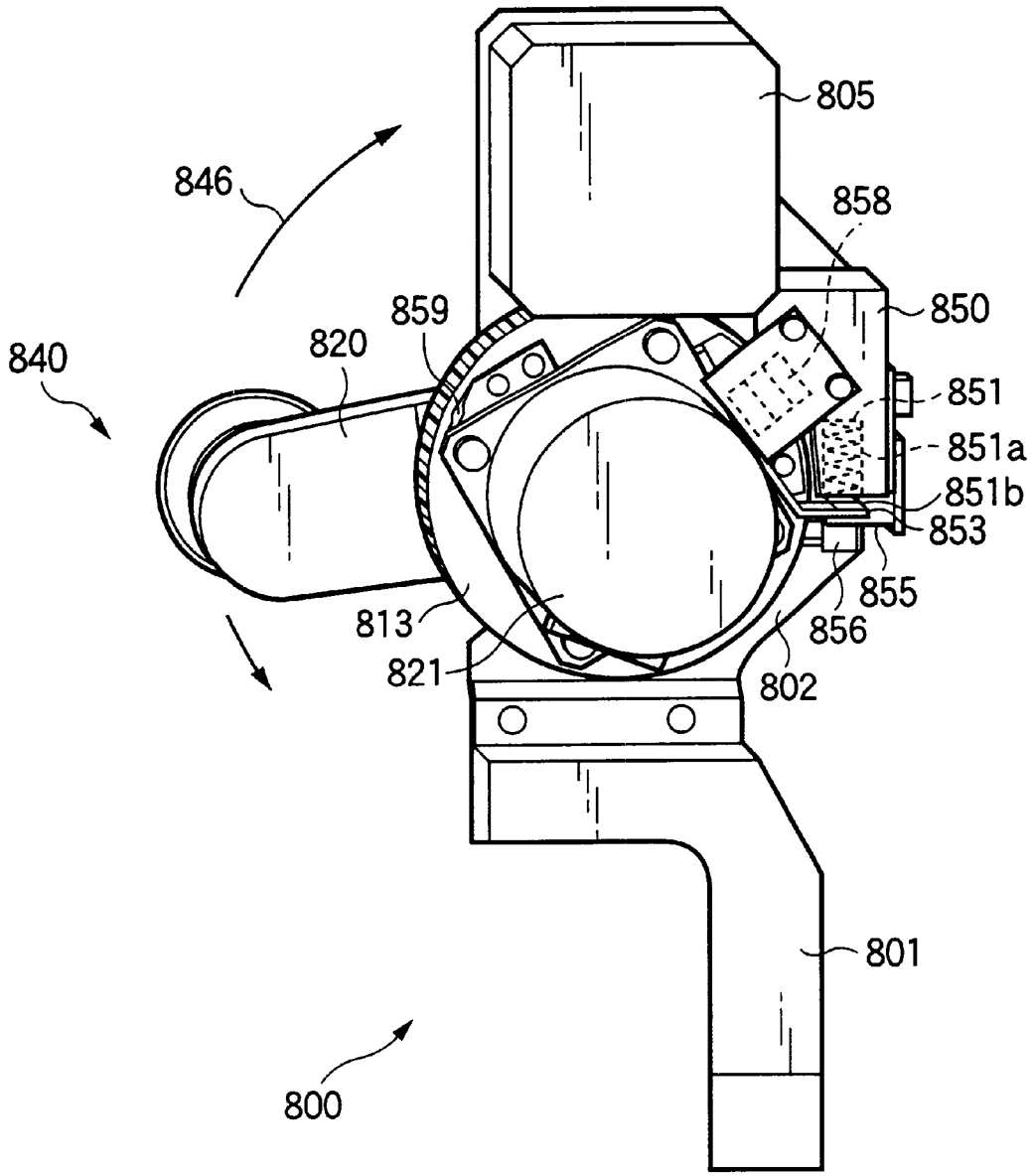
FIG. 12 is a left elevation of the chamfering and grooving mechanism section.

Referring to FIGS. 10 to 12, a description will be given of the construction of the chamfering and grooving mechanism section 800. FIG. 10 is a front elevational view of the chamfering and grooving mechanism section 800; FIG. 11 is a top view; and FIG. 12 is a left side elevational view.

A fixed plate 802 for attaching the various members is fixed to a supporting block 801 fixed to the base 10. A pulse motor 805 for rotating an arm 820 (which will be described later) to move an abrasive wheel section 840 to a processing position and a retreated position is fixed on an upper left-hand side of the fixed plate 802 by four column spacers 806. A holding member 811 for rotatably holding an arm rotating member 810 is attached to a central portion of the fixed plate 802, and a large gear 813 is secured to the arm rotating member 810 extending to the left-hand side of the fixed plate 802. A gear 807 is attached to a rotating shaft of the motor 805, and the rotation of the gear 807 by the motor 805 is transmitted to the large gear 813 through an idler gear 815, thereby rotating the arm 820 attached to the arm rotating member 810.

In addition, an abrasive-wheel rotating motor 821 is secured to a rear (left-hand side in FIG. 10) of the large gear 813, and the motor 821 rotates together with the large gear 813. A rotating shaft of the motor 821 is connected to a shaft 823 which is rotatably held inside the arm rotating member 810, and a pulley 824 is attached to the other end of the shaft 823 extending to the interior of the arm 820. Further, a holding member 831 for rotatably holding an abrasive-wheel rotating shaft 830 is attached to a distal end of the arm 820, and a pulley 832 is attached to a left end (left-hand side in FIG. 11) of the abrasive-wheel rotating shaft 830. The pulley 832 is connected to the pulley 824 by a belt 835, so that the rotation of the motor 821 is transmitted to the abrasive-wheel rotating shaft 830.

The abrasive wheel section 840 for grinding and processing the periphery of the lens LE is mounted on a right end of the abrasive-wheel rotating shaft 830. The abrasive wheel section 840 is so constructed that a chamfering abrasive wheel 840*a* for a lens rear surface, a chamfering abrasive wheel 840*b* for a lens front surface, and a grooving abrasive wheel 840*c* provided between the two chamfering abrasive wheels 840*a* and 840*b* are integrally formed. The diameter of the grooving abrasive wheel 840*c* is about 30 mm, and the chamfering abrasive wheels 840*a* and 840*b* on both sides have processing slanting surfaces such that their diameters become gradually smaller toward their outward sides with the grooving abrasive wheel 840*c* as the center. (The diameter of the grooving abrasive wheel 840*c* is larger than the outmost diameter of each of the chamfering abrasive wheels 840*a* and 840*b*.)

It should be noted that the abrasive-wheel rotating shaft 830 is disposed in such a manner as to be inclined about 8 degrees with respect to the axial direction of the chuck shafts 702L and 702R, so that the groove can be easily formed along the lens curve by the grooving abrasive wheel 840*c*. Additionally, the slanting surface of the chamfering abrasive wheel 840*a* and the slanting surface of the chamfering abrasive wheel 840*b* are so designed that the chamfering angles for the edge corners of the lens LE chucked by the chuck shafts 702L and 702R are respectively set to 55 degrees and 40 degrees.

A block 850 is attached to this side on the left-hand side (this side on the left-hand side in FIG. 10) of the fixed plate 802, and a ball plunger 851 having a spring 851*a* is provided inside the block 850. Further, a limiting plate 853 which is brought into contact with a ball 851*b* of the ball plunger 851 is fixed to the large gear 813. At the time of starting the grooving or chamfering, the arm 820 is rotated together with the large gear 813 by the rotation of the motor 805, so that the abrasive wheel section 840 is placed at the processing position shown in FIG. 12. At this time, the limiting plate 853 is brought to a position for abutment against the ball 851*b*.

In FIG. 12, a sensor 855 for detecting the origin of the processing position is fixed below the block 850. As the sensor 855 detects the light-shielded state of a sensor plate 856 attached to the large gear 813 so as to detect the origin of the processing position of the abrasive wheel section 840, i.e., the position where the limiting plate 853 abuts against the ball 851*b* without application of the urging force due to the ball plunger 851. This information on the origin of the processing position is used during calibration for defining the distance between the abrasive wheel section 840 and the chuck shafts 702R and 702L.

Further, a sensor 858 for detecting the retreated position is fixed on an upper side of the block 850. As the sensor 858 detects a sensor plate 859 attached to the large gear 813, the sensor 858 detects the retreated position of the abrasive wheel section 840 which is rotated together with the arm 820 in the direction of arrow 846. The retreated position of the abrasive wheel section 840 is set at a position offset rightwardly from a vertical direction in FIG. 12.

The groove depth in groove processing is changed such that, with the vertical (Y-axis) movement of the carriage 701, the lens LE is moved with respect to the grooving abrasive wheel 840*c* placed at the processing position. The groove width is changed such that, with the horizontal (X-axis) movement of the carriage 701, the lens LE is moved with respect to the grooving abrasive wheel 840*c*.

Figure 13:
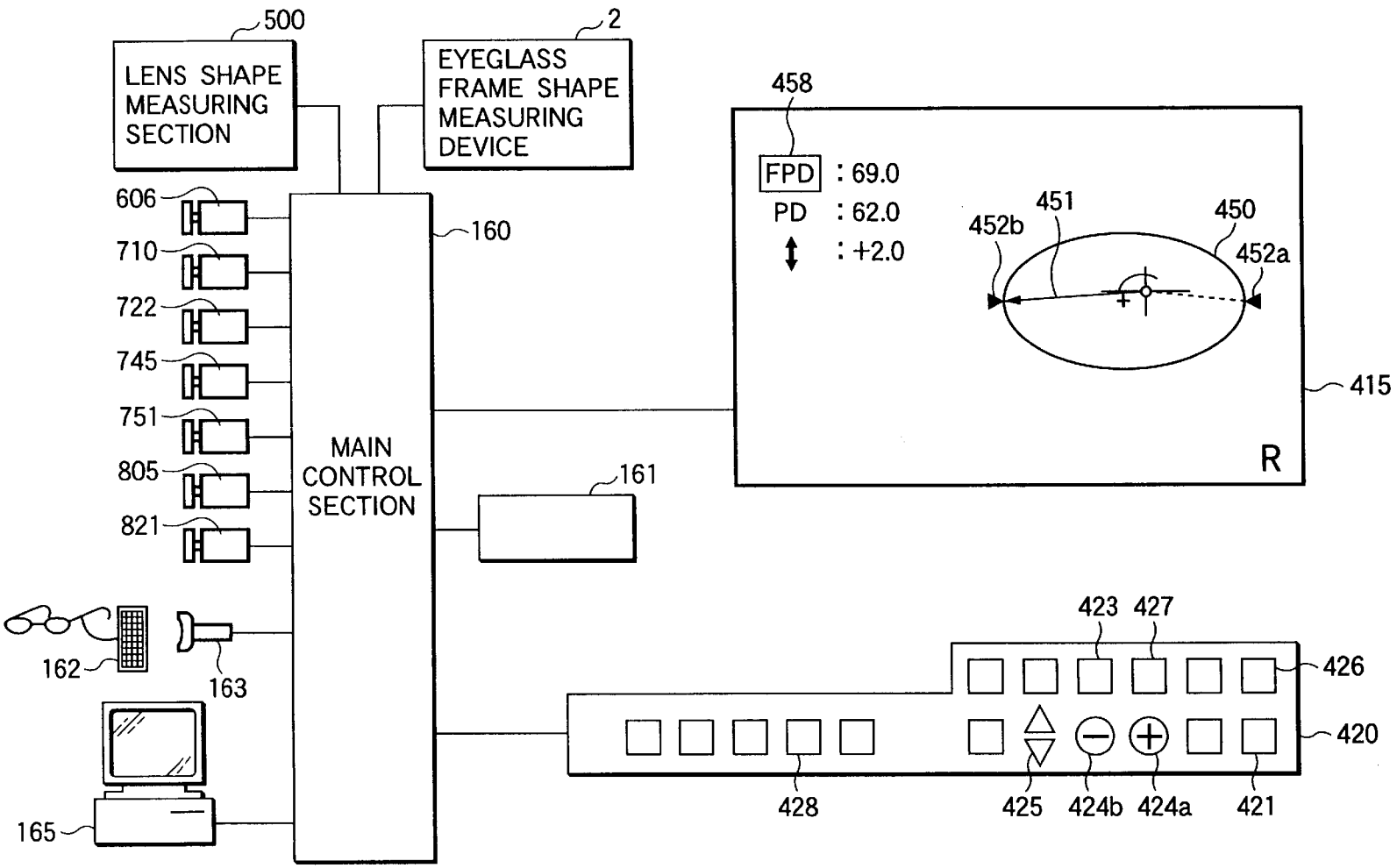
FIG. 13 is a block diagram of a control system of the apparatus.

The operation of the apparatus having such an arrangement as described above will now be described using the block diagram of a control system of FIG. 13.

Figure 14:
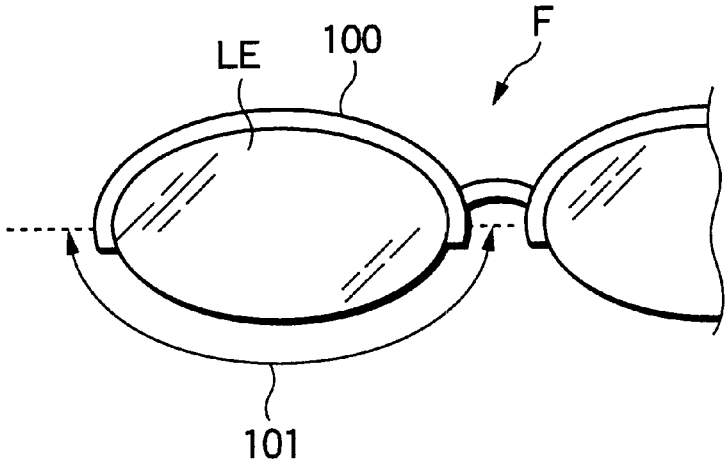
FIG. 14 is a diagram showing an example of the eyeglass frame in which the lens subjected to the lens periphery processing according to the invention is fitted.

First, description will be given of the case of partially changing the groove depth and width when the periphery of the lens LE is processed. For example, it is assumed that an eyeglass frame F shown in FIG. 14 is designed such that a metal frame portion 100 and a NYROL string are required to be both fitted into the groove of the lens LE. Assuming further that, in order to positively retain the NYROL string, a lower part (a range 101 indicated by an arrow in the drawing) of the groove formed in the lens LE needs to be larger in depth and width.

Prior to processing the lens LE, the target lens shape data (frame shape data) on an eyeglass frame is inputted. The target lens shape data can be obtained by measuring, by means of a frame shape measuring device 2, the shape of the dummy lens or the template which has been attached to the eyeglass frame F.

The target lens shape data obtained by the frame shape measuring device 2 is inputted to a data memory 161 by pressing a switch 421. As shown in FIG. 13, the target lens shape figure 450 based on the target lens shape data is displayed on a display 415, thus making it ready to input processing conditions and layout conditions. A processor inputs layout data such as a FPD value, a PD value, and a height of optical center by the operation switches on a switch panel section 420.

Also, a processing type change mode is selected by a mode switch 423 to input the data for changing the processing type (kind) partially for the lens LE periphery. This operation is performed as follows. By operating the "+" switch 424*a* or "−" switch 424*b* provided on the switch panel section 420, the rotating cursor 451 displayed within the target lens shape figure 450 is rotated and moved to the first point of the range where the processing type (grooving width, depth) is to be changed. Thereafter, the point is determined by an ENT switch 426. The mark 452*a* of the point determination is displayed on the profile line of the target lens shape figure 450. Next, the rotating cursor 451 is rotated up to the second point of the range where the metal frame portion 100 is to be fitted in the groove. Then, the point is determined by the ENT switch 426. A mark 452*b* is displayed at the determined second point, and the interval between the first point and the second point to which the rotating cursor 451 has been moved therefrom flashes on and off. Hence, a forced grooving mode is selected by the mode switch 423, and then determined by the ENT switch 426. This determination by the ENT switch 426 causes the remaining interval (the range where the NYROL string is to be fitted in the groove) to flash on and off. Hence, similarly, the forced grooving mode is selected by the mode switch 423, and determined by the ENT switch 426. Thereby, the ranges where the grooving depth and width are to be partially changed can be inputted. Hereinafter, the range on the upper side of the marks 452*a* and 452*b* will be referred to as a first grooving range, and the range on the lower side as a second grooving range.

Further, in case the range of the processing type is divided in further detail, a third point is determined after the determination of the second point, and the same operation is repeated.

Once any other necessary processing conditions can be inputted, the lens LE is held by two chuck shafts 702L, 702R. Thereafter, when a start switch 428 is pressed to operate the apparatus, the lens shape measuring section 500 is driven to execute a lens LE shape measurement in accordance with the target lens shape data. The main control section 160 rotates the lens LE with a feeler 517 abutting against the lens front-side refracting surface, and also vertically moves the carriage 701 based on the target lens shape data. Accompanied by this drive, the feeler 517 is moved in the horizontal direction along the shape of the lens front-side refracting surface. The amount of this movement is detected by an encoder 542, thus measuring the shape of the front-side refracting surface of the lens LE. The shape of the rear-side refracting surface of the lens LE is measured by causing a feeler 515 to abut against the lens surface so as similarly to detect the amount of movement of the feeler 515.

When the result of measurement of the lens LE shape is obtained, the main control section 160, based on the edge position information obtained by the lens shape measurement, makes a calculation for the processing data (the data on a groove path) on each range in accordance with a predetermined program. The groove path is obtained, for instance, such that the edge thickness of the lens LE is divided at a predetermined ratio.

Figure 15:
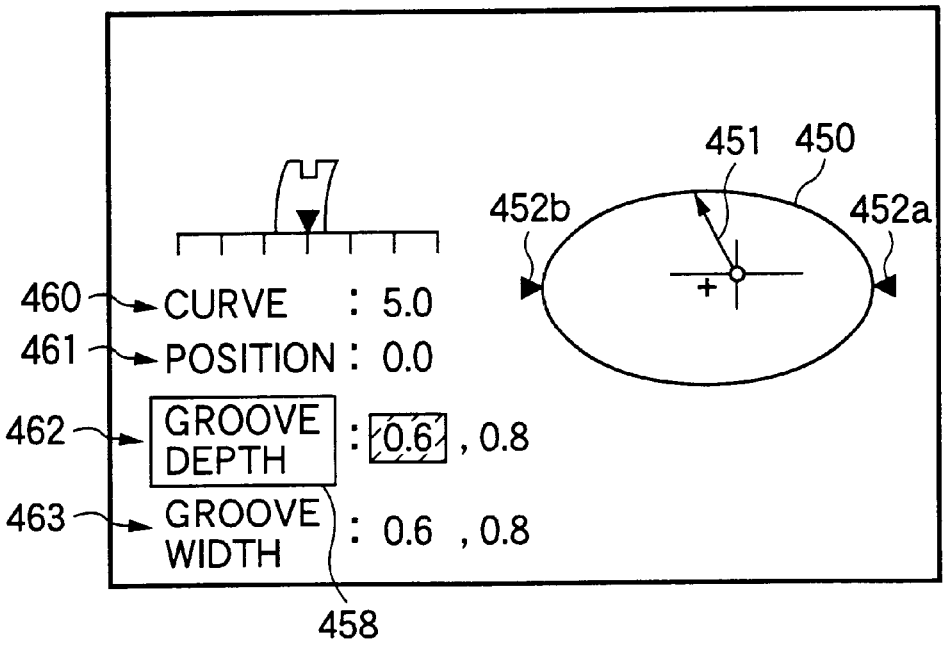
FIG. 15 is a diagram showing an example of the simulation screen incase the grooving depth and width are partially changed.

When the calculation of the processing data is completed, the screen of the display 415 is switched to a simulation screen. FIG. 15 is an example of the simulation screen. The approximate curve value obtained from the groove path data is displayed in a "curve" item 460. In case of changing this value, after a cursor 458 is put on the "curve" item 460 by the switch 425 on the switch panel section 420, the value can be changed by adjusting the switch 424*a* or 424*b* for increase or decrease in numeric value. When the curve value is changed, the groove path data approximate to the curve value is calculated again. The curve value is used as a practical representation of the lens curve on an eyeglass lens. A "position" item 461 is the item where the amount of offset by which the groove path is moved in parallel toward the lens front side or rear side is inputted.

The values of grooving depth and width to be partially changed are inputted as follows. When the rotating cursor 451 is rotated and positioned in the first grooving range on the target lens shape figure 450, the values of grooving depth and width in this range are made changeable. After the cursor 458 is put on a "groove depth" item 462 or a "groove width" 463, the value in the item is changed to increase or decrease with the switch 424*a* or 424*b*. The display of the right-side numeric value in each item indicates the current value, and the value to be changed is displayed as reversed indication. The groove depth and the groove width in the first grooving range are set to 0.6 mm and 0.6 mm, respectively.

Next, when the rotating cursor 451 is positioned in the second grooving range on the target lens shape figure 450, the values of grooving depth and width in this range are made changeable. Similarly, the respective values displayed as reversed indication are changed by putting the cursor 458 on the "groove depth" item 462 and the "groove width" item 463. The display of the right-side numeric value in each item indicates the current value. The groove depth and the groove width in the second grooving range are set to 0.8 mm and 0.8 mm, respectively. Upon input of the change in grooving depth and width, the data on the groove path is calculated again for each of the ranges where the groove forming condition is partially changed. In case of using the disk-like grooving abrasive wheel 840*c*, each boundary between the first and second grooving ranges is influenced by the diameter of the grooving abrasive wheel 840*c*. Hence, the groove path is calculated such that a depth of 0.8 mm of the second grooving range, i.e. a larger depth, is secured at each boundary.

Also, on the simulation screen, if the rotating cursor 451 displayed within the target lens shape figure 450 is rotated in the same way as described above to specify the edge position, the estimated edge sectional form to be obtained as a consequence of the processing is displayed in the left upper portion of the screen. Accordingly, a bevel sectional form or a groove sectional form can be confirmed over the entire periphery.

After the confirmation, processing is executed by pressing the start switch 428 again. First, the main control section 160 moves the carriage 701 such that the lens LE is placed above the rough abrasive wheel 602*a*, and vertically moves the carriage 701 to perform rough processing in accordance with the rough processing data preliminarily obtained on the basis of the target lens shape data and the layout data. Subsequently, the lens LE is moved to the planar portion of the finish abrasive wheel 602*b*, and the plane finishing processing over the entire periphery is performed in accordance with preliminarily obtained plane finishing processing data.

Thereafter, the groove processing is performed by the grooving abrasive wheel 840*c* in the chamfering and grooving mechanism section 800. After raising the carriage 701, the main control section 160 drives such that the abrasive wheel section 840 placed at the retreated position comes to the processing position, and then positions the lens LE on the grooving abrasive wheel 840*c*. Then, while rotating the lens LE, the main control section 160 controls the movement of the carriage 701 based on the groove path data which are set at 0.6 mm in groove depth and 0.6 mm in groove width in the first grooving range. Incidentally, the abrasive wheel width of the grooving abrasive wheel 840*c* in the embodiment is set to 0.6 mm, which is to be the minimum groove width.

In the second grooving range, first, the main control section 160 controls the movement of the carriage 701 so that the lens LE is processed to have a groove width of 0.6 mm by one revolution of the lens LE. Thereafter, in order to further process the lens LE to add the remaining width of 0.2 mm only in this second grooving range, the main control section 160 controls, while rotating the lens LE, the movement of the carriage 701 in the horizontal direction (in the axial direction of the chuck shafts 702L, 702R) based on the groove path data. Also, in order to have a groove depth of 0.8 mm in this second grooving range, the main control section 160 controls the vertical movement of the carriage 701. Thus, the processing which is partially different in grooving width and depth is performed with respect to the periphery of the lens LE.

Description will now be given of the case where the bevel finishing processing and the groove processing are performed over the periphery of the lens LE. For example, it is assumed that the eyeglass frame F shown in FIG. 14 is designed such that a bevel groove is formed in the rim portion 100, i.e. an upper part of the frame F, and the lens LE is held by the NYROL string in the lower portion (the range 101 indicated by an arrow in the drawing) below the rim portion 100.

Figure 16:
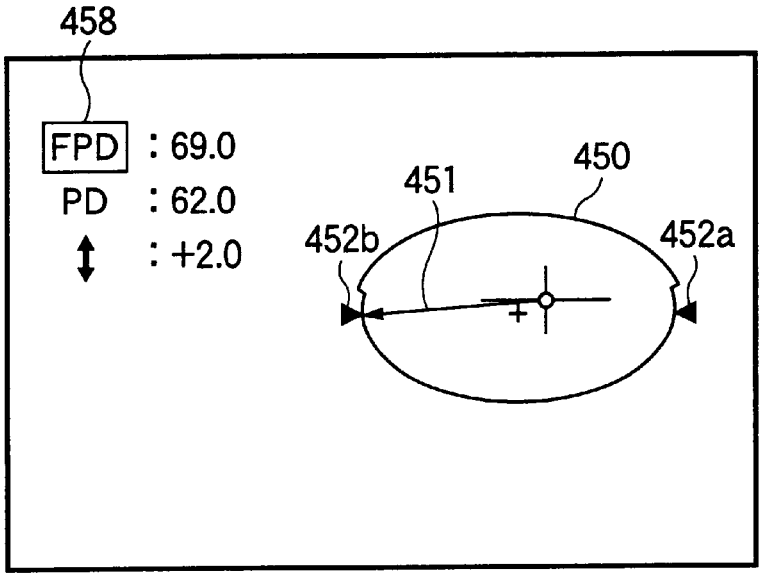
FIG. 16 is a diagram showing an example of the layout screen in case bevel processing and groove processing are performed.

Similarly to the previous example, when the target lens shape data obtained by the frame shape measuring device 2 is inputted, as shown in FIG. 16, the target lens shape figure 450 is displayed on the display 415, thus making it ready to input processing conditions and layout conditions. After the layout data is inputted, a processing type change mode is selected by the mode switch 423, and, in the same way as described above, the divided portions, i.e. the bevel processing range and the grooving range, are determined by the point specification using the rotation of the rotating cursor 451 and the ENT switch 426. The interval between the first point and the second point to which the rotating cursor 451 has been moved therefrom flashes on and off. Hence, a forced beveling mode is selected by the mode switch 423, and then determined by the ENT switch 426. This determination by the ENT switch 426 causes the remaining interval to flash on and off. Hence, in order to form the groove in this range, the forced grooving mode is selected by the mode switch 423, and determined by the ENT switch 426.

In case where the target lens shape data is obtained by measuring the dummy lens using the frame-shape measuring device 2, the inflection points of the beveling portion and grooving portion can be obtained. Hence, it can also be arranged such that the data on the points with which the processing ranges are defined are automatically inputted based on these inflection points. In this case, it is preferable that the points with which the processing ranges are defined are determined in view of the shape of the joint between the beveling portion and the grooving portion on the basis of the diameter of the finishing abrasive wheel 602*b*.

After the data input of the processing ranges, the start switch 428 is pressed, thereby executing a lens shape measurement. When the result of measurement of the lens LE shape is obtained, based on the edge position information obtained by the lens shape measurement and the data on the respective processing ranges to be subjected to bevel processing and groove processing, the main control section 160 calculates for the bevel path data and groove path data which are the processing data on the respective ranges. At this time, on the basis of the beveling surface shape which the finishing abrasive wheel 602*b* has, the bevel path data is preferably corrected such that the bevel shoulder portion to be formed on the periphery of the lens LE and the plane finishing portion to be subjected to groove processing are smoothly joined.

Figure 17:
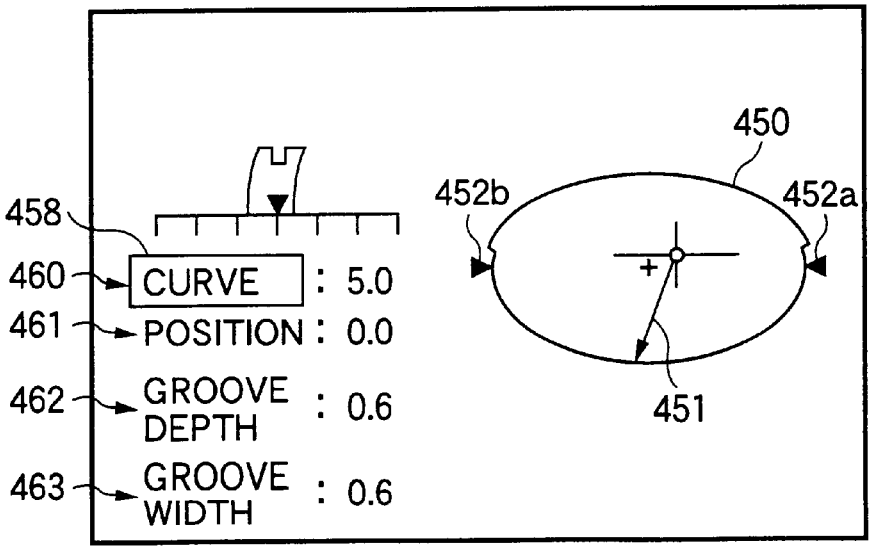
FIG. 17 is a diagram showing an example of the simulation screen in case bevel processing and groove processing are performed.

When the processing data is obtained, the screen of the display 415 is switched to the simulation screen as shown in FIG. 17. Hence, the values in the "curve" item 460 etc. are changed in the same way as described above to obtain desired bevel path and groove path. Also, each of the grooving depth and width can be changed by putting the cursor 458 on the item 462, 463 and then increasing or decreasing the value in the item 462, 463 with the switch 424*a* or 424*b*. When the curve value, the grooving width or the groove depth is changed, the processing data on each range is calculated again.

Processing is executed by pressing the start switch 428 again. First, the main control section 160 moves the carriage 701 such that the lens LE is placed above the rough abrasive wheel 602*a*, and vertically moves the carriage 701 to perform rough processing in accordance with the rough processing data based on the target lens shape data and the layout data. The rough processing data is calculated, taking into account the grinding margin for bevel finishing processing and the grinding margin for the plane finishing processing prior to grooving.

Next, the lens LE is moved to the planar portion of the finish abrasive wheel 602*b* to perform plane finishing processing on the peripheral portion where the groove processing is to be performed. This plane finishing processing is performed in accordance with the aforesaid groove processing range data. Namely, the main control section 160 drives the motor 722 to rotate the lens LE held by the two chuck shafts 702L, 702R, and also performs the plane finishing processing while, in the range of a radius vector angle where the groove processing is to be performed, pressing the lens LE against the planar portion of the finish abrasive wheel 602*b* by vertically moving the carriage 701. In any other range than the groove processing range, the carriage 701 is moved such that the lens LE escapes from the finish abrasive wheel 602*b*.

Subsequently, the lens LE is moved to the bevel groove portion of the finish abrasive wheel 602*b* to perform bevel finishing processing. In the range where the bevel finishing processing is to be performed, while moving the carriage 701 vertically and in the axial direction of the chuck shafts 702L, 702R based on bevel apex path data, the bevel finishing processing is performed with the lens LE pressed against the bevel groove portion of the finish abrasive wheel 602*b*.

After completion of the finish processing, next, the chamfering and grooving mechanism section 800 is driven to proceed to the groove processing. The main control section 160 raises the carriage 701, and then rotates the motor 805 by a predetermined number of pulses so that the abrasive wheel 840 placed at the retreated position comes to the processing position. Thereafter, the carriage 701 is moved vertically and in the axial direction, whereby the lens LE is positioned on the grooving abrasive wheel 840*c*, thus performing the processing by controlling the movement of the carriage 701 based on the data on the groove path in the aforesaid groove processing range.

In addition to the above examples, the processing with respect to the periphery of the lens LE can also be executed with the plane finishing processing partially combined. In this case, similarly, the processing range is specified by the rotating cursor 451 on the layout data input screen shown in FIG. 13, 16, and the plane finishing processing is selected by the mode switch 423, thereby inputting the data for changing the processing range and the processing type.

Further, the apparatus in the embodiment is provided with a polish abrasive wheel 602*c*. Hence, the apparatus can also perform partial polish processing on the lens periphery after the finish processing. In case the polish processing is partially performed, for example, a polish range change mode is selected by a polish switch 427 on the switch panel section 420 with the layout screen shown in FIG. 13 displayed, thus changing to the mode in which the polish processing can be partially specified. Then, in the same way as described above, the rotating cursor 451 is rotated, and two points of the range to be subjected to the polish processing are specified on the target lens shape figure 450. The points are determined by the ENT switch 426, thereby inputting the data on the range where the polish processing is to be performed.

In case the partial polish processing is specified, the main control section 160 moves the lens LE to the polish abrasive wheel 602*c* after the bevel finishing processing and the plane finishing processing. In case the polish finishing range is the portion where the bevel finishing processing has been performed, the polish finishing processing is performed by the bevel groove portion of the polish finishing abrasive wheel 602*c* based on the polish finishing range data. In case the polish finishing range is the portion where the plane finishing processing has been performed, the polish finishing processing is performed by the planar portion of the polish finishing abrasive wheel 602*c* based on the polish finishing range data.

Further, the target lens shape data is obtained by the measurement by means of the frame shape measuring device 2. In addition, in case the target lens shape data is known beforehand at an eyeglass frame maker, the same data is inputted for use. For example, the two-dimensional code tag 162 including the target lens shape data is attached to the eyeglass frame F. The data is inputted by reading it by the code reader 163 coupled to the main control section 160 (see FIG. 13). Instead of the two-dimensional code tag 162, an IC chip or an IC card can also be used as a storage medium. Still further, the target lens shape data obtained from the eyeglass frame maker is made to correspond with the model number etc. of an eyeglass frame, and stored in the database of an external computer 165. Then, the target lens shape data is retrieved by specifying the model number etc. of the eyeglass frame, and inputted to the processing apparatus body side. Furthermore, there can also be adopted a method of using the data downloaded into the external computer 165 coupled to the database of the frame maker via a communication network such as internet etc.

In case of using such target lens shape data designed at the eyeglass frame maker, if the data includes the range where the processing is to be partially changed (the data on the points where the aforesaid first and second grooving ranges are to be changed, and the data on the points where the beveling and grooving are to be changed), then the need to input by an operator is eliminated. Further, in case of the groove processing, the data of the groove depth and width in each range can be included. Such design data on an eyeglass frame are used intactly, thereby improving the precision of a processed shape.

In the embodiment, the disk-like grooving abrasive wheel is used as a grinding tool for groove processing. The present invention is also applicable to a case that the groove processing is executed using an end mill.

As described above, according to the invention, the (kind of) processing to be performed over the lens periphery can be partially changed, thus enabling expansion of the degree of freedom with respect to the design of a frame and a lens.

What is claimed is:

1. An eyeglass lens processing apparatus for processing a periphery of an eyeglass lens, comprising:

a detecting unit, which detects an edge position of the lens based on inputted target lens shape data and layout data;

a processing unit, which has at least one grinding tool and which processes the lens periphery by relatively moving the lens with respect to the grinding tool, the at least one grinding tool being used in plural processing modes including at least two of:

a plane finish processing mode in which the lens periphery is finished flatly;

a bevel finish processing mode in which the lens periphery is finished with a bevel formed to the lens periphery;

a plane polish processing mode in which the lens periphery is finished and polished flatly;

a bevel polish processing mode in which the lens periphery is finished and polished with a bevel formed to the lens periphery; and a groove processing mode in which the lens periphery is finished with a groove formed to the lens periphery;

a first setting unit, which divides the lens periphery into plural ranges;

a second setting unit, which sets different processing modes for the plural ranges, respectively;

a computing unit, which obtains processing data for the respective ranges, different in processing mode, based on data on edge position and data on the set different processing modes corresponding respectively to the ranges; and a control unit, which generates a control signal to the processing unit based on the obtained processing data.

2. The apparatus of claim 1, wherein:

data on the plural ranges of the lens periphery include range data designed at an eyeglass frame maker and stored in a storage medium together with the target lens shape data; and the first setting unit reads the range data together with the target lens shape data from the storage medium and sets these data.

3. The apparatus of claim 1, wherein:

data on the plural ranges of the lens periphery include range data designed at an eyeglass frame maker together with the target lens shape data; and the first setting unit sets the range data and the target lens shape data via a communications net work.

4. The apparatus of claim 1, wherein the first setting unit includes:

a display unit, which displays a target lens shape figure based on the inputted target lens shape data; and a specifying unit, which specifies the plural ranges on the displayed target lens shape figure.

5. The apparatus of claim 1, wherein the second setting unit includes a selection unit, which selects, from the plural processing modes, the different processing modes for each of the plural ranges.

6. The apparatus of claim 1, further comprising:

a measuring unit, which measures a configuration of an eyeglass frame, a template or a dummy lens, and inputs data on the measured configuration as the target lens shape data.

7. The apparatus of claim 1, further comprising:

a layout input unit, which inputs the layout data for layout of the lens with respect to the inputted target lens shape data.

8. An eyeglass lens processing apparatus for processing a periphery of an eyeglass lens, comprising:

a detecting unit, which detects an edge position of the lens based on inputted target lens shape data and layout data;

a processing unit, which has at least one grinding tool and which processes the lens periphery by relatively moving the lens with respect to the grinding tool, the at least one grinding tool being used in plural processing modes including at least:

a first groove processing mode in which the lens periphery is finished with a first groove formed to the lens periphery; and a second groove processing mode in which the lens periphery is finished with a second groove, different in at least one of groove width and groove depth from the first groove, formed to the lens periphery;

a first setting unit, which divides the lens periphery into plural ranges;

a second setting unit, which sets different processing modes for the plural ranges respectively;

a computing unit, which obtains processing data for the respective ranges, different in processing mode, based on data on edge position and data on the set different processing modes corresponding respectively to the ranges; and a control unit, which generates a control signal to the processing unit based on the obtained processing data.

9. The apparatus of claim 1, wherein the first setting unit divides the lens periphery into the plural ranges based on designation by an eyeglass frame maker.

10. The apparatus of claim 1, further comprising a display unit, which displays a target lens shape figure based on the inputted target lens shape data, the set plural ranges and a sectional figure of the edge of at least one of the ranges.

11. The apparatus of claim 10, wherein the first setting unit includes:

a display unit, which displays a target lens shape figure based on the inputted target lens shape data; and a specifying unit, which specifies the plural ranges on the displayed target lens shape figure.

12. The apparatus of claim 10, wherein the second setting unit includes a selection unit, which selects, from the plural processing modes, the different processing modes for each of the plural ranges.

13. The apparatus of claim 11, wherein the first setting unit divides the lens periphery into the plural ranges based on designation by an eyeglass frame maker.

14. The apparatus of claim 10, further comprising a display unit, which displays a target lens shape figure based on the inputted target lens shape data, the set plural ranges and sectional figure of the edge of at least one of the ranges.

* * * * *